US008985393B1

(12) United States Patent
Ellison

(10) Patent No.: US 8,985,393 B1
(45) Date of Patent: Mar. 24, 2015

(54) SOUND PRODUCING LIQUID DISPENSER AND LIQUID POURING DEVICES

(71) Applicant: Matthew Blake Ellison, Lake Tapps, WA (US)

(72) Inventor: Matthew Blake Ellison, Lake Tapps, WA (US)

( * ) Notice: Subject to any disclaimer, the term of this patent is extended or adjusted under 35 U.S.C. 154(b) by 0 days.

(21) Appl. No.: 14/274,597

(22) Filed: May 9, 2014

(51) Int. Cl.

| | |
|---|---|
| ***B65D 47/32*** | (2006.01) |
| ***B65D 47/12*** | (2006.01) |
| ***B65D 55/00*** | (2006.01) |
| ***B65D 51/24*** | (2006.01) |
| *B65D 81/36* | (2006.01) |

(52) U.S. Cl.
CPC ..... *B65D 47/121* (2013.01); *B65D 55/00* (2013.01); *B65D 47/32* (2013.01); *B65D 51/248* (2013.01); *B65D 81/366* (2013.01)
USPC ..... 222/39; 222/478; 222/566; 222/78

(58) Field of Classification Search
CPC .. B65D 51/248; B65D 81/365; B65D 81/366; B65D 55/00; B65D 47/121; B65D 47/32
USPC ..... 222/39, 78, 478, 566, 567; 446/216
See application file for complete search history.

(56) References Cited

U.S. PATENT DOCUMENTS

| | | | | |
|---|---|---|---|---|
| 491,571 | A * | 2/1893 | Long | 446/215 |
| 2,106,097 | A * | 1/1938 | Homan | 426/104 |
| 2,477,984 | A * | 8/1949 | Jackson | 222/78 |
| 3,219,237 | A * | 11/1965 | Jackson | 222/78 |
| 4,227,482 | A | 10/1980 | Scheindel | |
| 4,674,654 | A | 6/1987 | Fujii et al. | |
| 5,213,234 | A | 5/1993 | Stefanopoulos | |
| 6,193,104 | B1 | 2/2001 | Cho | |

FOREIGN PATENT DOCUMENTS

| | | | |
|---|---|---|---|
| FR | 2573408 A1 * | 5/1986 | 222/78 |

OTHER PUBLICATIONS

Image of Japanese sake container, 2 pp., interior and exterior views (prior to 2010).
Images of bird wine bottle stoppers (prior to 2010).
Abrahams, Marc; "A British analysis of the physics of a tea kettle whistle," Improbable Research, http://www.improbable.com/2013/10/24/a-british-analysis-of-the-physics-of-a-tea-kettle-whistle/ (Oct. 24, 2013).

* cited by examiner

*Primary Examiner* — Kevin P Shaver
*Assistant Examiner* — Nicholas J Weiss
(74) *Attorney, Agent, or Firm* — Ann W. Speckman; Speckman Law Group PLLC

(57) ABSTRACT

A sound producing liquid dispenser has a structure sized and configured to seal an opening in a container, a liquid outlet opening for dispensing liquid from the container, a separate air passageway allowing air to flow between the interior and exterior of the container, and a sound producing mechanism located in proximity to the air passageway. A contoured outer housing covering all or parts of the pour spout, the air introduction tube and the sound producing mechanism may be provided. Various types of sound producing mechanisms are useful, including mechanisms having curved, perforated plates. In particular embodiments, the sound produced during or following a pouring operation sounds like birdsong, and in some embodiments, a contoured outer housing is provided in the form of a bird.

9 Claims, 5 Drawing Sheets

SOUND PRODUCING LIQUID DISPENSER AND LIQUID POURING DEVICES

TECHNICAL FIELD

The present disclosure relates to liquid dispensers and liquid pouring devices capable of producing sounds during or following the dispensing of liquids.

BACKGROUND

Various types of liquid dispensers are known and are in common usage. Some dispensers, including some pitchers, are capable of producing sound as liquid is poured, or as liquid is poured from a (fully or partially) liquid-filled pitcher and then as the pitcher is moved from a pouring position back to an upright position. The movement of liquid and air relative to one another during and after pouring produces sound as a result of the configuration of the interior volume and the contour of the internal surface of the pitcher. One such sound producing pitcher is sold under the trademark GURGLEPOT.

Dispensers for dispensing oils, liquor and other liquids or flowable materials typically comprise a stopper having an opening or pour spout for dispensing oil, liquor or the like, and a separate opening or tube allowing air to enter the container interior as liquid is dispensed, or as the liquid displacement or position of liquid in the container interior changes.

Liquid dispensers having an air introduction tube with a sound generating mechanism for mounting to container openings are known. U.S. Pat. No. 4,674,654, for example, discloses a liquid dispenser having a pouring nozzle and a separate air introduction tube that produces an agreeable sound when liquid is poured from the container. The diameter and length of the air introduction tube may be selected to produce intermittent or pulsating air flow when liquid is poured and it is this air flow, in combination with a sound producing mechanism such as a small hole or holes, or a reed, that produces desired sounds. U.S. Pat. No. 6,193,104 discloses a spout mountable on a liquid container with a T-shaped passage for generating bird noises. The outer configuration of the spout may be provided in the form of a bird.

Ceramic sake pitchers having a bird-like outer configuration and incorporating an internal sound-producing mechanism were also produced. The sound chamber was formed as an internal, donut-shaped hollow ceramic element with a central air passage. The beak of the bird forms a pour spout and a passage in the back of the head provides air flow to the sound-producing mechanism, while the body of the bird provides the liquid reservoir.

SUMMARY

The present disclosure, in one aspect, relates to a sound producing liquid dispenser comprising a stopper sized and configured to seal an opening in a container, a liquid outlet opening for dispensing liquid from the container, a separate air passageway allowing air to flow between the interior and exterior of the container, and a sound producing mechanism located in proximity to the air passageway. In some embodiments, the liquid outlet opening is provided as a pour spout sized and is configured for pouring a flowable material (such as a liquid) from a container interior, and the air passageway is provided as an air introduction tube associated with a sound producing mechanism. In some embodiments, the sound producing liquid dispenser additionally comprises a contoured outer housing operatively associated with and covering all or parts of the pour spout, the air introduction tube and the sound producing mechanism. In particular embodiments, the sound produced during or following a pouring operation sounds like birdsong, and in some embodiments, a contoured outer housing is provided in the form of a bird.

In some embodiments, the sound producing mechanism is formed integrally with the dispenser housing; in some embodiments, the sound producing mechanism is formed integrally with an air introduction tube; and in other embodiments, the sound producing mechanism is mounted to or otherwise associated with the air introduction tube. An air introduction tube may be provided, for example, as a generally linear, curved or angular tube, and a sound producing mechanism may be provided at an exterior terminal portion of the air introduction tube.

In some embodiments, the sound producing mechanism may comprise a sound chamber extending generally transversely or at another angular orientation from an axis of an air introduction tube. In some embodiments, the sound chamber comprises at least two transverse walls, each transverse wall having at least one opening allowing passage of air. The transverse walls may have curved profiles and the openings may be aligned. In some embodiments, a reed may be positioned at an opening of the sound chamber to provide the sound producing mechanism. Other types of sound producing mechanisms, whistles, and the like having an air passageway may be employed.

A contoured outer housing may be provided in the form of a three dimensional figurine or another contoured shape that is ornamental or abstract, or that has a well-known or distinctive form (e.g., is branded) and is operatively associated with (e.g., connected or connectable to) the stopper. The contoured outer housing may be formed integrally with or associated with or mounted over other components of the sound producing liquid dispenser. In some embodiments, the contoured outer housing has an opening providing pouring of liquids from the container, and the contoured housing additionally has at least one opening providing access to the air passageway and sound producing mechanism. The contoured housing may be formed as a bird, for example, with its open beak providing a pour spout and opening(s) between rearwardly-facing portions of its wings providing an air passageway communicating with the sound producing mechanism. Other outer housing configurations are disclosed and illustrated herein, and yet additional outer housing configurations in the form of animals, objects, ornamental or abstract shapes, branded forms, and the like, may be provided.

DETAILED DESCRIPTION

Figures 1A, 1B:
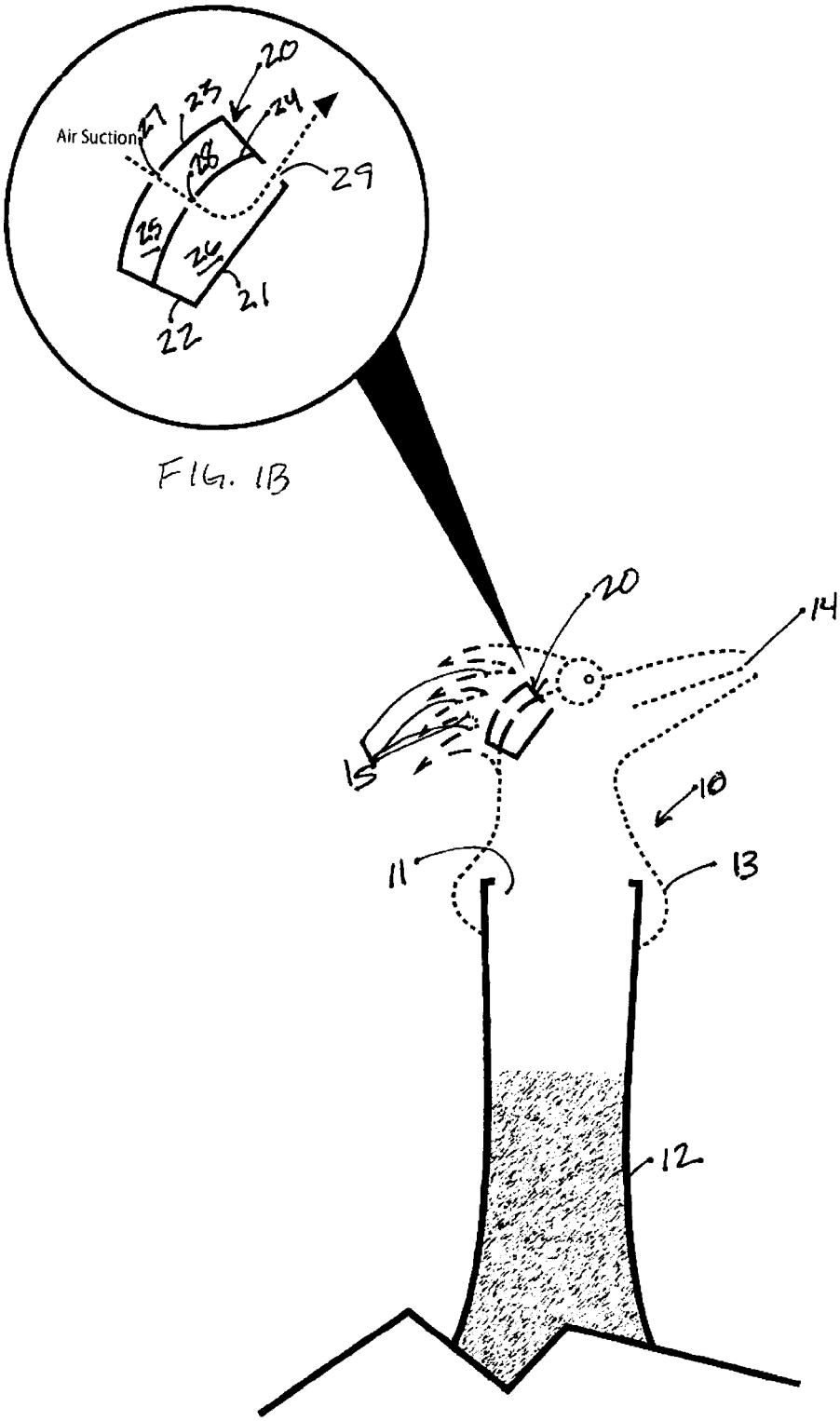
FIG. 1A illustrates a side, cut-away view of an exemplary sound producing liquid dispenser, as disclosed herein, mounted at an opening in a container, with a contoured outer housing shown in dashed lines.
FIG. 1B illustrates an enlarged side view of a portion of an exemplary sound producing mechanism forming a part of the dispenser of FIG. 1A.

FIG. 1A illustrates a schematic side, cut-away view of a sound producing liquid dispenser 10 as disclosed herein mounted over an opening 11 of container 12. In this illustrative embodiment, container 12 has an elongated neck and a reservoir for holding liquids or other types of flowable materials. Liquid dispenser 10 comprises a closure device or stopper 13 sized and configured to fit snugly over opening 11 of container 12. In the illustrated embodiment, stopper 13 is sized and configured for contacting an exterior wall of a container opening and sealing against the exterior wall surface in a substantially liquid-tight and air-tight manner. It will be appreciated that in alternative embodiments, stoppers having various sizes and configurations for sealing container openings may be provided. In alternative embodiments, for example, a stopper having interface mechanisms or contours that mate with complementary interface mechanisms or contours on an internal or external surface of the container opening, such as screw threads, bayonet-mount configurations or other mechanical mating systems may be provided. In yet additional alternative embodiments, a stopper as contemplated herein may be formed integrally with, or as part of, a container.

External walls of stopper 13 provide at least one opening serving as a pour spout sized and configured for pouring a flowable material (such as a liquid) from a container interior, and at least one air passageway associated with a sound producing mechanism. In the embodiment illustrated in FIG. 1A, the outer walls of stopper 13 are configured in the form of a bird head, although many different outer configurations may be implemented, as previously described. Opening 14 provides a pour spout, while air passageways 15 provide air flow between the exterior and interior of the container and provide communication with sound producing mechanism 20, illustrated in the enlarged view of FIG. 1B. Sound producing mechanism 20 is generally provided as a plastic or metallic component and is stably mounted at a fixed location within stopper 13 in proximity to air passageways 15.

In the exemplary embodiment illustrated in FIGS. 1A and 1B, sound producing mechanism 20 has a generally cylindrical or frustoconical exterior configuration and comprises bottom wall 21, side wall(s) 22, and plates 23, 24 forming sound chambers 25, 26. Plates 23, 24 are provided as thin plates having a thickness of less than 1 mm, in some embodiments, less than 0.5 mm, and in yet other embodiments, less than 0.3 mm. Sound producing mechanism 20, including plates 23, 24, may be constructed from metallic or plastic materials and, in some embodiments, are constructed from materials such as stainless steels or other materials that are easily and conveniently sanitized. In alternative embodiments, plates 23, 24 may be provided as membranes having one or more perforations and may be constructed from non-rigid or semi-rigid materials capable of being suspended in a generally taut condition across the chamber opening(s).

Each plate 23, 24 has at least one air passageway (shown as air passageways 27, 28). In the embodiment illustrated in FIG. 1B, air passageways 27, 28 are formed as bores in plates 23, 24 and are aligned in a central region of the plates. In the embodiment illustrated in FIGS. 1A and 1B, an additional air passageway 29 is provided in side wall 22 and provides access to an interior portion of the dispenser 10 and container 12. In alternative embodiments, this air passageway or additional air passageways may be provided in other locations in side wall 22, or in bottom wall 21.

Sound producing mechanism 20 produces sound as air is drawn through the air passageways in the plates and transits the sound chambers during or following pouring of liquid from the container. In the embodiment illustrated in FIGS. 1A and 1B, plates 23, 24 are curved and have generally the same profile. Convex curved plates having a relatively large radius, such as arc radii of from about 10° to 40° are suitable; in some embodiments, convex, curved plates having arc radii of from about 12° to about 30° are provided; and in yet additional embodiments, convex, curved plates having arc radii of from about 16° to 21° are provided for making bird-like sounds. Plates having other curved configurations or other angular geometries may also be used to generate other types of sounds.

The sound chamber configuration illustrated in FIGS. 1A and 1B produces a bird-like "tweeting" sound as liquid is poured, or as the liquid container is moved from a pouring to an upright position. Sound chambers having different configurations, different orientations, different arrangement of plates, air holes, and the like, and sound chambers constructed from different materials, produce different sounds as a result of air passage. It will be appreciated that sound chambers having a variety of configurations and orientations may be provided to produce different types of sounds.

While the dispenser illustrated in FIGS. 1A and 1B is illustrated as having a substantially hollow interior volume without defined passageways for liquid and air flow, it will be appreciated that an internal passageway for liquid flow terminating at pour spout 14 may be provided, and that one or more internal passageway(s) providing air flow between sound producing mechanism 20 and the internal volume of container 12 may also be provided.

Figures 2A, 2B:
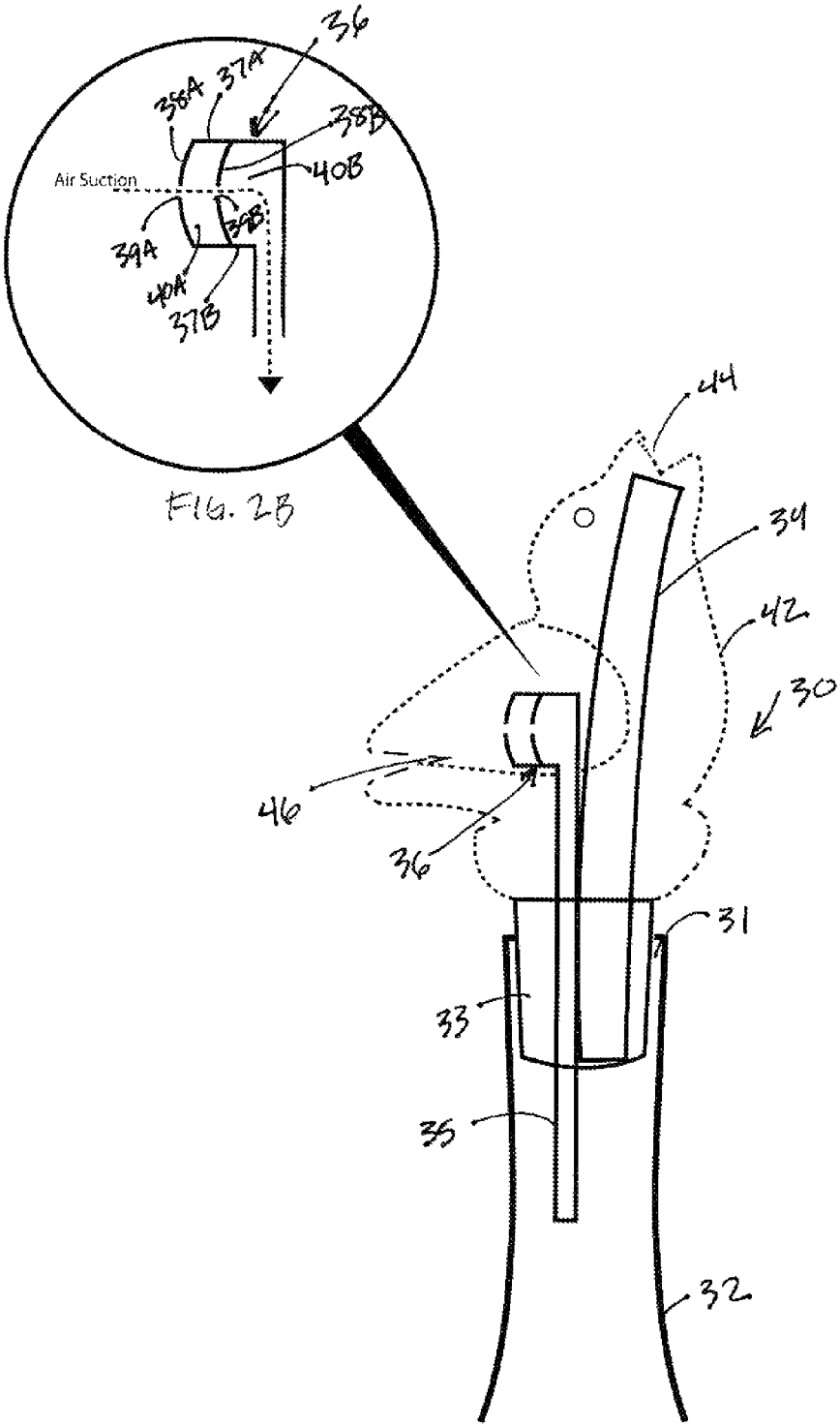
FIG. 2A illustrates a side, cut-away view of another exemplary sound producing liquid dispenser, as disclosed herein, mounted in an opening in a container, with a contoured outer housing shown in dashed lines.
FIG. 2B illustrates an enlarged side view of a portion of an exemplary sound producing mechanism forming a part of the dispenser of FIG. 2A.

FIG. 2A illustrates a schematic side, cut-away view of a sound producing liquid dispenser 30 as disclosed herein mounted in an opening 31 of container 32. In this illustrative embodiment, container 32 has an elongated neck and a reservoir for holding liquids or other types of flowable materials. Liquid dispenser 30 comprises a closure device or plug or stopper 33 sized and configured to fit snugly within opening 31 of container 32. In the illustrated embodiment, stopper 33 is sized and configured for contacting an interior wall of a container opening and sealing against the interior wall surface in a substantially liquid-tight and air-tight manner. It will be appreciated that stoppers having various sizes and configurations may be provided for fitting into openings of containers having various sizes and configurations.

In some embodiments, stopper 33 is constructed (entirely or in part) from a material having resilient sealing properties, such as natural or synthetic cork, natural or synthetic rubber (y) materials, and plastic materials having an appropriate resilience, flexibility or durometer to provide a seal when mounted at a container opening. In some embodiments, stopper 33 may be constructed entirely from such materials; in alternative embodiments, stopper 33 may be constructed from rigid materials that may not be capable of forming an appropriate seal on their own when interfaced with an inner container opening, with rings or ridges or other protuberances comprising a sealing material provided for sealing against an inner surface of a container opening.

Dispenser 30 additionally comprises a pour spout 34 defining a liquid passageway transiting the stopper and an air introduction tube 35 defining an air passageway transiting the stopper, each configured and positioned to access both an interior space of container 32 and a location exterior to container 32. In some embodiments, as shown in FIG. 2A, pour spout 34 and air introduction tube 35 are provided as tubular structures that substantially penetrate stopper 33. Pour spout 34, as shown, has a larger diameter than air introduction tube 35 and may be sized to extend a desired or convenient distance from an exterior region of stopper 33. Varying the length or diameter of pour spouts provides different liquid flow rates and may affect the sound and tonal patterns, as well as the sound volume produced using different types of sound producing mechanisms. Pour spout 34 may have a circular, oblong, polygonal or other cross-sectional configuration, and may have a substantially constant cross-sectional dimension along its length; alternatively, pour spout 34 may taper along its length. In some embodiments, as illustrated in FIG. 2A, pour spout 34 may be curved. Pour spout 34 is generally fabricated from a substantially rigid, non-corrosive, liquid-impervious material such as a metallic or plastic material.

Air introduction tube 35 may be formed as a tubular structure and positioned in stopper 33 so that an exterior portion projects exteriorly of the stopper and an interior portion projects into an interior container space when dispenser 30 is mounted on a container, as shown in FIG. 2A. Air introduction tube 35 may have a smaller internal cross-sectional configuration than that of pour spout 34, as shown, and it may have a circular, oblong, polygonal or other cross-sectional configuration. It may have a substantially constant cross-sectional dimension along its length, or it may taper. In some embodiments, the internal cross-sectional area of the air introduction tube is less than 60% the internal cross-sectional area of the pour spout; in some embodiments, the internal cross-sectional area of the air introduction tube is less than 50% the internal cross-sectional area of the pour spout; and in some embodiments, the cross-sectional area of air introduction tube is less than 40% the cross-sectional area of pour spout. In some embodiments, the inner diameter of the pour spout is between 5 and 10 mm, and the inner diameter of the air introduction tube is between 2 and 5 mm.

Both pour spout 34 and air introduction tube 35 may be oriented in the stopper with their longitudinal axes aligned generally transverse to a container opening, and generally aligned with or aligned parallel to a longitudinal axis of the neck or liquid reservoir of a container. In some embodiments, both pour spout 34 and air introduction tube 35 are oriented in the stopper with their longitudinal axes within 30° (or, in other embodiments, within 20° or 10°) of being parallel to a longitudinal axis of the container when the stopper is closing the container. In some embodiments, air introduction tube 35 projects from both interior and exterior surfaces of stopper 33, while pour spout 34 projects only from an exterior surface of stopper 33, as illustrated in FIG. 2A.

Air introduction tube 35 may be formed integrally with or may be associated with a sound producing mechanism, illustrated in FIG. 2A as sound generator 36. In the exemplary embodiment illustrated in FIGS. 2A and 2B, one wall of sound generator 36 is formed as an extension of air introduction tube 35, and side walls 37A, 37B extend from this extension. In the embodiment illustrated, sound chamber side walls 37A, 37B extend generally perpendicularly from the extension of air introduction tube 35, but other configurations may be suitable. Sound generator 36 additionally comprises two spaced plates, outer plate 38A and inner plate 38B, each having at least one bore or opening (39A, 39B) and, in combination with side walls, forming intermediate sound chambers 40A, 40B. Outer and inner plates 38A, 38B may be curved and have generally the same profile, as shown. Convex curved plates having a relatively large arc radius are appropriate, as described above in connection with the description of FIGS. 1A and 1B, but plates having other curved or contoured configurations may be used. Sound generator 36 is generally positioned intermediate an exterior end of stopper 33 and a terminal end of pour spout 34, as shown in FIG. 2A.

The sound generator configuration illustrated in FIGS. 2A and 2B produces a bird-like "tweeting" sound as liquid is poured, or as the liquid container is moved from a pouring to an upright position. Sound generators having different designs, different configurations, different orientations, different arrangement of plates, air holes, and the like, and sound chambers constructed from different materials, produce different sounds as a result of air passage. It will be appreciated that sound chambers having a variety of configurations and orientations may be provided to produce different types of sounds.

Contoured outer housing 42 may take a variety of forms and configurations, as previously described. In the illustrated embodiment, housing 42 is provided in the form of a bird having an open beak 44 located near or forming the terminus of the pour spout and an opening 46 formed between rearwardly-facing portions of its wings providing an air passage that communicates with the sound generator 36 and air introduction tube 35. It will be appreciated that outer housings having a variety of configurations, shapes, sizes, and the like may be provided and, in some embodiments, different and complementary outer house configurations may be provided to match, or to contrast with, different sounds produced by different types of sound producing mechanisms. In general, contoured outer housing may be formed from a variety of materials, including metal, plastic, ceramic, glass, or the like.

Figures 3A, 3B:
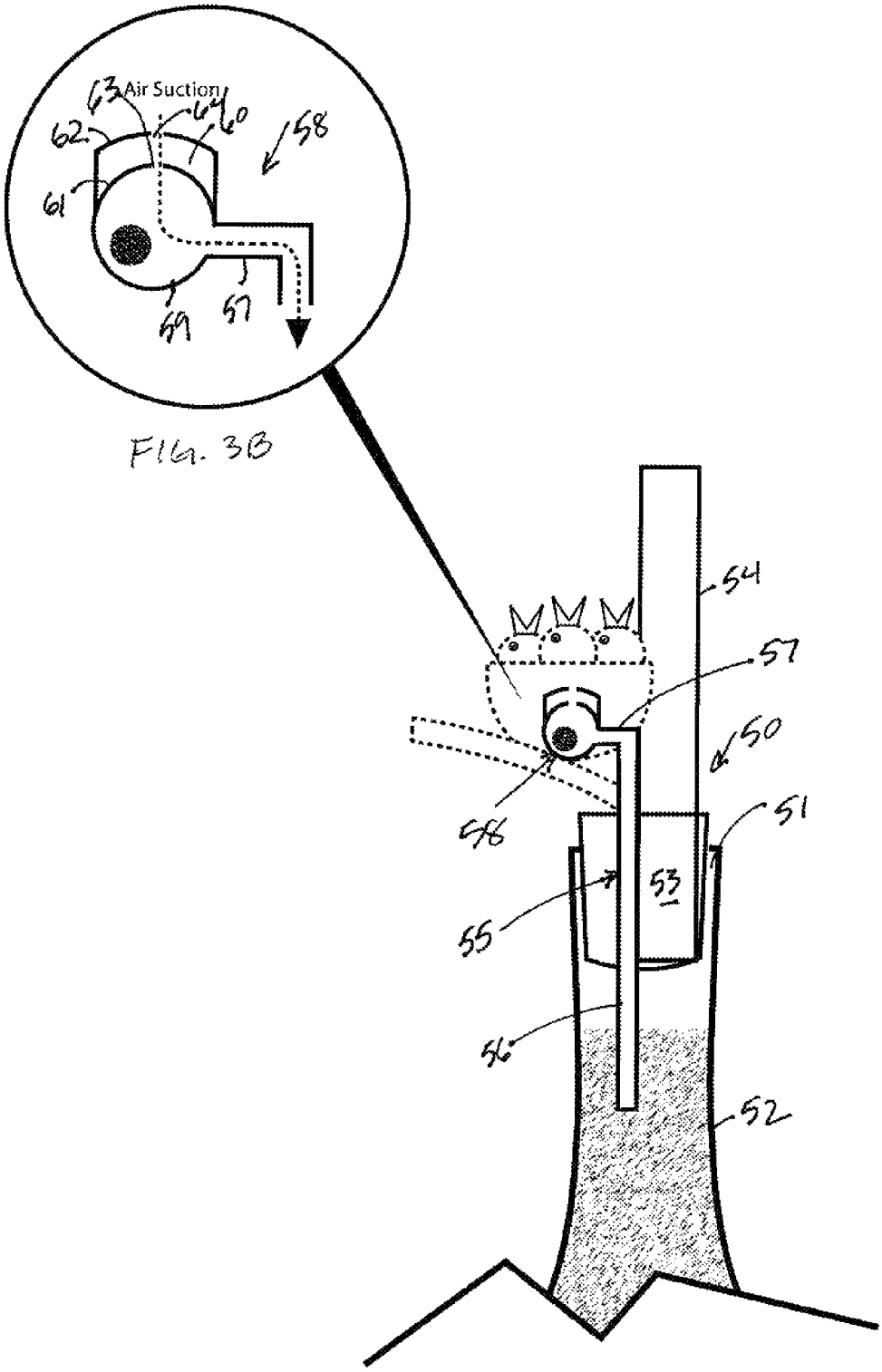
FIG. 3A illustrates a side, cut-away view of another exemplary sound producing liquid dispenser, as disclosed herein, mounted in an opening in a container, with a contoured outer housing shown in dashed lines.
FIG. 3B illustrates an enlarged side view of a portion of an exemplary sound producing mechanism forming a part of the dispenser of FIG. 3A.

FIG. 3A illustrates a schematic side, cut-away view of another sound producing liquid dispenser 50 as disclosed herein mounted in an opening 51 of container 52. In this illustrative embodiment, liquid dispenser 50 comprises a stopper or plug 53 sized and configured to fit snugly within opening 51 of container 52. In the illustrated embodiment, stopper 53 is sized and configured for contacting an interior wall of a container opening and sealing against the interior wall surface in a substantially liquid-tight and air-tight manner. Stoppers as described elsewhere herein and having various sizes and configurations may be provided for fitting into openings of containers.

Dispenser 50 additionally comprises a pour spout 54 and an air introduction tube 55, each configured and positioned to access both an interior space of container 52 and a location exterior to container 52. Air introduction tube 55 may be formed as a tubular structure and positioned in stopper 53 so that an exterior portion projects exteriorly of the stopper and an interior portion projects into an interior container space when dispenser 50 is mounted in a container, as shown in FIG. 3A. In this embodiment, pour spout 54 is provided as a cylindrical, generally linear tubular structure, and air introduction tube 55 has a smaller cross-sectional configuration and has two angled, linear sections, with one tubular section 56 extending below stopper 53 into the internal volume of container 52, and an angled tubular section 57 extending generally transversely and communicating with sound producing mechanism 58.

In the embodiment illustrated in FIGS. 3A and 3B, sound producing mechanism 58 has a generally spherical sound chamber 59 communicating with tubular section 57 and a neighboring sound chamber 60. Spaced surfaces 61, 62 each have at least one bore or opening (63, 64) and, in combination with side walls, enclose the neighboring sound chambers. In the embodiment illustrated in FIG. 3A, one or more object(s), such as lightweight sphere(s) constructed, for example, from cork, plastic or rubber, are positioned in spherical sound chamber 59. During and following pouring of liquid from the container, the air turbulence produced within the sound chambers produces movement of the lightweight spheres, which changes the sound pattern and may produce a trilling sound.

The contoured outer housing may take a variety of forms and configurations, as previously described. In the embodiment illustrated in FIG. 3A, pour spout 54 may be configured as a tree trunk or branch, and the sound producing mechanism may be positioned in the interior of a housing configured as a bird nest resting on a lower branch, with bird beaks providing air passageways to the sound chambers and air introduction tube. Many other contoured outer housing configurations may also be used.

Figure 4A:
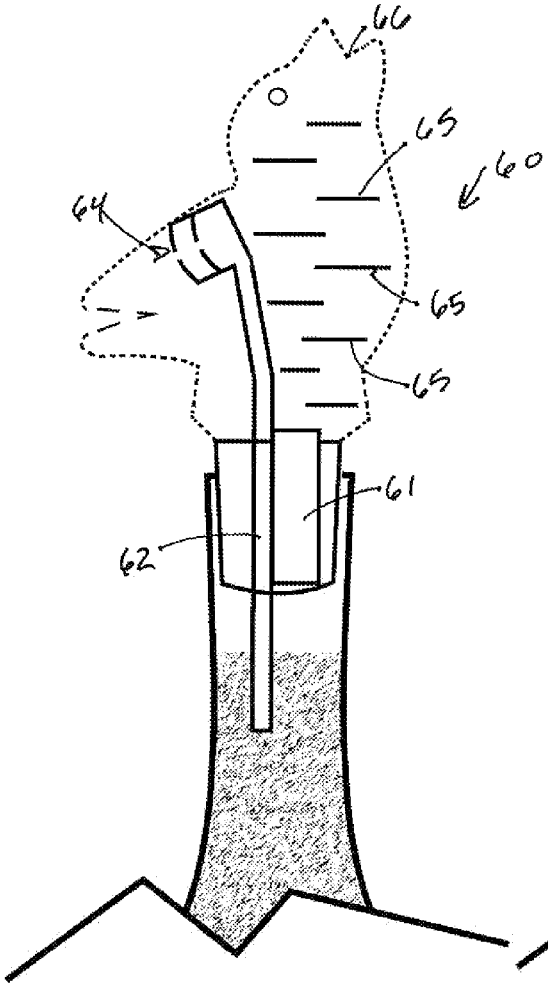
FIG. 4A illustrates a side, cut-away view of another exemplary embodiment of a sound producing liquid dispenser, as disclosed herein, mounted in an opening in a container, with a contoured outer housing shown in dashed lines.
Figure 4B:
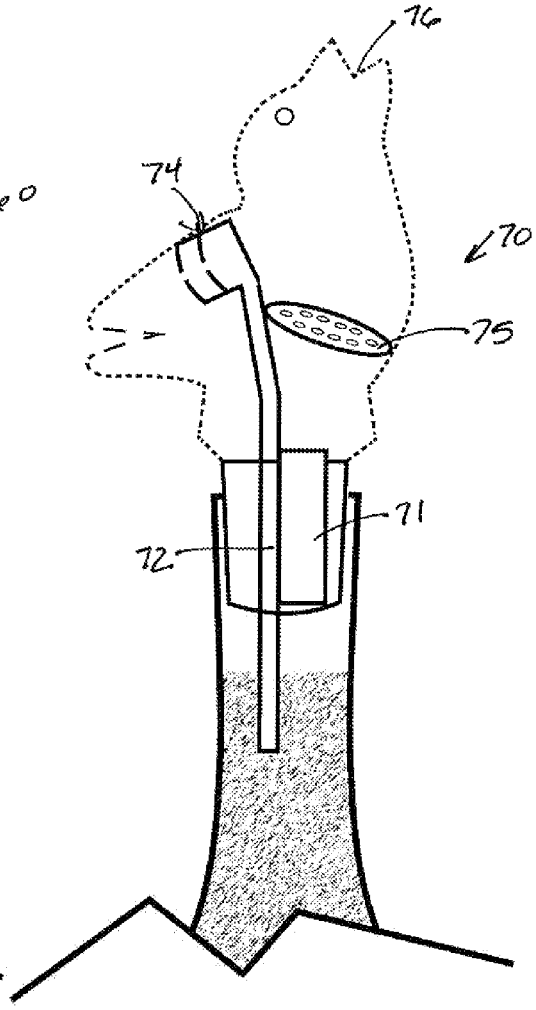
FIG. 4B illustrates a side, cut-away view of yet another exemplary embodiment of a sound producing liquid dispenser, as disclosed herein, mounted in an opening in a container, with a contoured outer housing shown in dashed lines.

FIGS. 4A and 4B illustrate yet additional embodiments of liquid dispensers as described herein having internal baffles or perforated plate(s) to produce and promote aeration of liquids as they transit the pour spout and are dispensed. In these embodiments, liquid dispensers 60, 70 comprise a stopper or plug sized and configured to fit snugly within an opening of the container. Dispensers 60, 70 additionally comprise liquid pour passageways or tubes 61, 71 transiting the stopper and air introduction tubes 62, 72, each configured and positioned to access both an interior space of the container and the sound producing mechanisms 64, 74, which may be provided as sound producing mechanisms described in this disclosure, or as other types of sound producing mechanisms. In the embodiments illustrated in FIGS. 4A and 4B, air introduction tubes 62, 72 have angular configurations and sound producing mechanisms 64, 74 are similar to those shown and described with reference to the embodiments of FIGS. 2A and 2B, but are positioned angularly rather than transversely with respect to the air introduction tubes and the container opening.

In these embodiments, liquid from the container transits liquid passageways 61, 62 and the interior volume of liquid dispensers 60, 70 when the liquid container and dispenser is tilted. In the embodiment illustrated in FIG. 4A, a plurality of baffles 65 are positioned in the interior volume of liquid dispenser 60, and the flow of liquid being poured toward opening 66 is disrupted and aerated by flow across and around the baffles 65. In the embodiment illustrated in FIG. 4B, a perforated plate 75 is positioned in the interior volume of liquid dispenser 70, and the flow of liquid being poured toward opening 76 is similarly disrupted and aerated by passage through perforated plate 75. In some embodiments, both one or more baffles and one or more perforated plates may be implemented to disrupt the liquid as it flows toward the dispenser opening. Different numbers, configurations and placement of baffles or perforated plates may provide desired liquid disruption and aeration.

While the liquid dispensers illustrated in FIGS. 4A and 4B are illustrated as having substantially hollow interior volumes without defined passageways for liquid flow, it will be appreciated that an internal liquid flow passageway terminating at the pour spout (66, 76) may be provided, and that one or more baffles or perforated plates may be positioned in or in proximity to an internal liquid passageway.

Figure 5B:
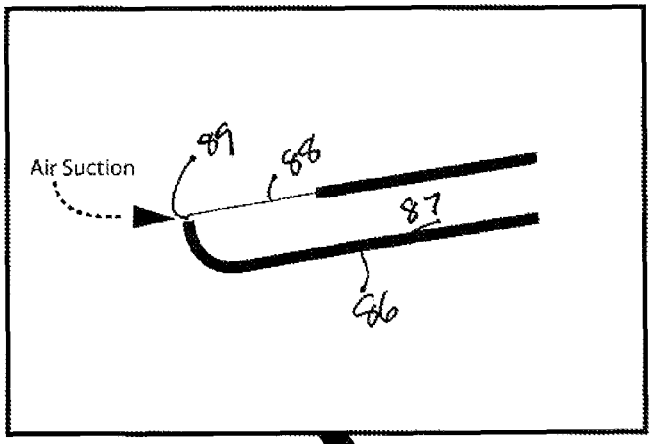
FIG. 5B illustrates an enlarged side view of a portion of another exemplary sound producing mechanism forming a part of the dispenser of FIG. 5A.
Figure 5A:
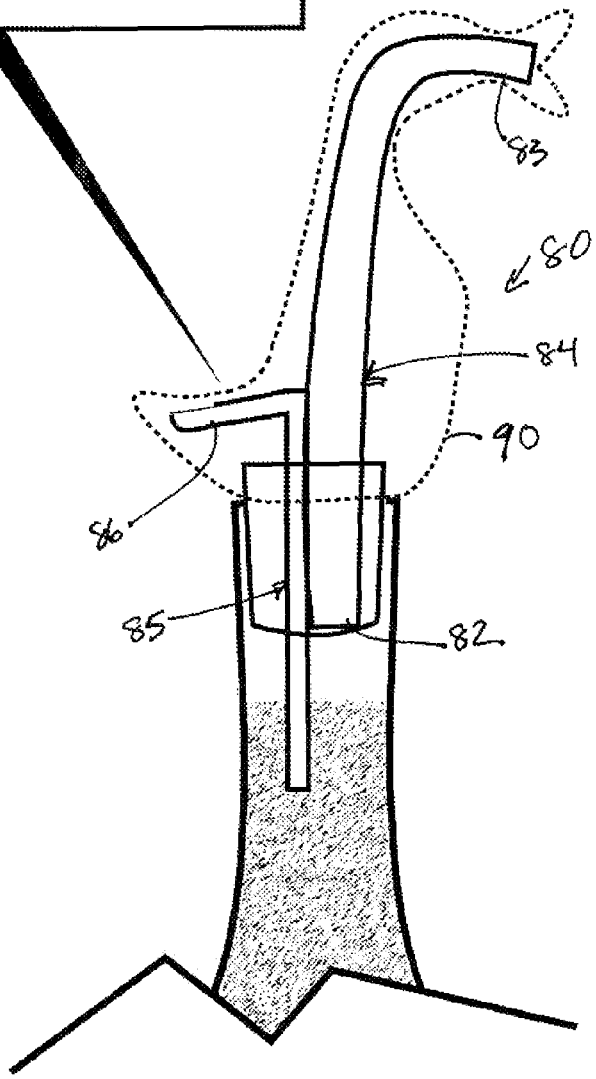
FIG. 5A illustrates a side, cut-away view of another exemplary sound producing liquid dispenser, as disclosed herein, mounted in an opening in a container, with a contoured outer housing shown in dashed lines.

FIGS. 5A and 5B illustrate yet another embodiment of a liquid dispenser having sound producing capabilities. In this embodiment, liquid dispenser 80 comprises a stopper or plug sized and configured to fit snugly within or across an opening of the container. Dispenser 80 additionally comprises a liquid pour spout 84 and an air introduction tube 85, each configured and positioned to access both an interior space of the container and a location exterior to container. In this embodiment, pour spout 84 has a generally tubular configuration and an internal diameter at the external spout area 83 that is smaller than the internal diameter at the container opening area 82. In this embodiment, pour spout 84 has a curved configuration, wherein its central longitudinal axis at spout area 83 is generally transverse to its central longitudinal axis at container opening area 82. Air introduction tube 85 is provided as tubular structure that penetrates the stopper and extends into the internal space of the container, and has an angled terminal section 86 forming sound chamber 87. A reed 88 is provided in an opening of sound chamber 87 and is positioned to provide an air opening 89 into sound chamber 87.

As air passes through air opening 89 during or following pouring of liquid from the container through the liquid pour spout, vibration of the reed produces sound. The contoured outer housing of this embodiment may take a variety of forms and configurations, as previously described. In the illustrated embodiment, outer housing 90 is provided in the form of a duck or goose having an open beak located near or forming the terminus of the pour spout and an opening between rearwardly-facing portions of its wings providing an air passage that communicates with the sound chamber 87 and air introduction tube 85.

A liquid dispenser having a configuration similar to that shown in FIGS. 2A and 2B was constructed and tested. The decibel level of sound produced during or following a pouring operation produced sound at a level of between 64 and 74 decibels at a distance of 3 feet from the dispenser. The decibel level of human conversation at normal volumes is approximately 60 dB. Liquid dispensers as disclosed herein preferably produce sound at a decibel level of greater than 60 dB at a distance of 3 feet from the dispenser during or following pouring of liquid from a container and, in some embodiments, produce sound at a decibel level of greater than 64 dB at a distance of 3 feet from the dispenser during or following pouring of liquid from a container.

In the description provided above, the term "about" means +/−20% of the indicated value or range unless otherwise indicated. The terms "a" and "an," as used herein, refer to one or more of the enumerated components or items. The use of alternative language (e.g., "or") will be understood to mean either one, both or any combination of the alternatives, unless otherwise expressly indicated. The terms "include" and "comprise" are used interchangeably and both of those terms, and variants thereof, are intended to be construed as being non-limiting.

It will be appreciated that the methods and systems of the present invention may be embodied in a variety of different forms, and that the specific embodiments shown in the figures and described herein are presented with the understanding that the present disclosure is considered exemplary of the principles of the invention, and is not intended to limit any claimed subject matter to the illustrations and description provided herein. The various embodiments described may be combined to provide further embodiments. The described devices, systems, methods and compositions may omit some elements or steps, add other elements or steps, or combine the elements or execute steps in a different order than that specifically described.

I claim:

1. A liquid dispenser comprising: a stopper sized and configured to close a container having a liquid reservoir and an opening; a contoured housing operatively associated with the stopper, the housing having a liquid outlet opening and at least one air opening; a liquid passageway transiting the stopper and the contoured housing and accessing the liquid outlet opening; an air introduction tube transiting the stopper and the contoured housing; and a sound producing mechanism associated with the air introduction tube wherein the sound producing mechanism comprises a sound chamber formed by side walls and spaced plates, and wherein the side walls are oriented generally perpendicular to the air introduction tube and the spaced plates are transverse to the side walls, and wherein each of the spaced plates has at least one opening.

2. The liquid dispenser of claim 1, wherein the stopper is sized and configured to fit snugly over the container opening.

3. The liquid dispenser of claim 1, wherein the stopper is sized and configured to fit snugly within the container opening.

4. The liquid dispenser of claim 1, wherein the stopper has interface mechanisms that mate with complementary interface mechanisms located at the container opening.

5. The liquid dispenser of claim 1, wherein the sound producing mechanism comprises two spaced plates, and each of the spaced plates has a convex curved configuration and at least one opening.

6. The liquid dispenser of claim 1, wherein the liquid passageway transiting the stopper and the contoured housing and accessing the liquid outlet opening is defined by a tubular pour spout.

7. The liquid dispenser of claim 1, wherein the contoured outer housing has an outer configuration in the form of a bird with the liquid outlet opening provided at a beak and the at least one air opening formed between wings.

8. The liquid dispenser of claim 1, additionally comprising at least one baffle positioned in the liquid passageway transiting the contoured housing.

9. The liquid dispenser of claim 1, additionally comprising at least one perforated plate positioned in the liquid passageway transiting the contoured housing.

* * * * *